US011353183B1

(12) United States Patent
Zhang

(10) Patent No.: US 11,353,183 B1
(45) Date of Patent: Jun. 7, 2022

(54) STARRY SKY PROJECTION APPARATUS

(71) Applicant: BI RAY ELECTRONIC TECHNOLOGY CO., LTD, Shenzhen (CN)

(72) Inventor: Xugai Zhang, Wuxue (CN)

(73) Assignee: BI RAY ELECTRONIC TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/580,200

(22) Filed: Jan. 20, 2022

(51) Int. Cl.

| | |
|---|---|
| ***F21S 10/00*** | (2006.01) |
| ***F21V 23/00*** | (2015.01) |
| ***F21V 33/00*** | (2006.01) |
| ***F21V 17/16*** | (2006.01) |
| ***F21S 9/02*** | (2006.01) |
| ***F21Y 115/10*** | (2016.01) |

(52) U.S. Cl.
CPC ..... *F21S 10/007* (2013.01); *F21S 9/02* (2013.01); *F21S 10/002* (2013.01); *F21V 17/16* (2013.01); *F21V 23/003* (2013.01); *F21V 33/0052* (2013.01); *F21Y 2115/10* (2016.08)

(58) Field of Classification Search
CPC ..... F21S 10/007; F21S 10/063; F21S 9/02; F21S 10/002; F21V 17/16; F21V 23/003; F21V 33/0052; F21Y 2115/10; F21W 2121/008
See application file for complete search history.

(56) References Cited

U.S. PATENT DOCUMENTS

| | | | | |
|---|---|---|---|---|
| 7,703,940 | B2 * | 4/2010 | Dalton | F21S 6/002 362/396 |
| 10,830,410 | B1 * | 11/2020 | Wei | F21V 23/02 |
| 11,118,745 | B2 * | 9/2021 | Zheng | F21V 29/70 |
| 11,156,352 | B1 * | 10/2021 | Li | F21S 10/007 |
| 2017/0175963 | A1 * | 6/2017 | Lentine | F21V 23/001 |
| 2021/0148548 | A1 * | 5/2021 | Hou | F21V 7/0008 |
| 2021/0164628 | A1 * | 6/2021 | Zheng | F21V 5/02 |
| 2021/0381666 | A1 * | 12/2021 | Zheng | F21V 5/005 |

* cited by examiner

*Primary Examiner* — Peggy A Neils
(74) *Attorney, Agent, or Firm* — Li & Cai Intellectual Property (USA) Office

(57) ABSTRACT

A starry sky projection apparatus relates to the technical field of projection lamps, comprising a starry sky lamp body, wherein the starry sky lamp body is provided with a base and a housing, and a projection lamp assembly is disposed in the housing, and the projection lamp assembly comprises: a gobo mapper, wherein the gobo mapper is provided with a slot, and the housing is provided with a replacement slot on one side adjacent to the slot, and the slot is for a user to insert different gobos through the replacement slot. An optical lens is detachably provided on the housing. The optical lens is provided with a plurality of different mirror surfaces, and the plurality of optical lenses can be replaced by the user to display a variety of different nebulae.

8 Claims, 4 Drawing Sheets

STARRY SKY PROJECTION APPARATUS

FIELD OF THE DISCLOSURE

The present disclosure relates to the technical field of projection lamps, in particular, to a starry sky projection apparatus.

BACKGROUND OF THE DISCLOSURE

LED lights refer to lamps that use light-emitting diode (LED) technology as the main light source. LED, or semiconductor light-emitting diode, is a solid-state semiconductor element that uses current to flow forward to the coupling of the semiconductor P-N junction, and then the two carriers of negatively charged electrons and positively charged holes separated from the semiconductor are combined with each other later, to produce photon emission, different types of LEDs can emit light of different wavelengths ranging from infrared to blue, and violet to ultraviolet. Traditional lamps are generally divided into two types. The first type has a complicated structure and is not easy to install and maintain due to the need to achieve a beautiful appearance; the second type can only meet one lighting effect because of its single form and cannot meet consumer requirements. The decoration enhances the atmosphere. Therefore, a starry sky projection apparatus appears on the market to meet the above requirements. However, the existing starry sky lights are often troublesome to replace the projection screen and cannot customize the projection screen, making the projection effect too simple.

SUMMARY OF THE DISCLOSURE

The purpose of the present disclosure is to provide a starry sky projection apparatus in view of the defects and deficiencies of the prior art, which has the advantages of convenience of changing the projection screen, and can independently DIY pattern sheets according to customer needs, thereby customizing the projection screen and making the projection effect diversified.

In order to achieve the above objective, the technical solution adopted by the present disclosure is to provide a starry sky projection apparatus, comprising a starry sky lamp body, wherein the starry sky lamp body is provided with a base and a housing, and a projection lamp assembly is disposed in the housing, and the projection lamp assembly comprises: a gobo mapper, wherein the gobo mapper is provided with a slot, and the housing is provided with a replacement slot on one side adjacent to the slot, and the slot is for a user to insert different gobos through the replacement slot.

In a preferred embodiment, an optical lens is detachably disposed on the housing.

In a preferred embodiment, wherein starry sky lamp body further comprises: a control circuit board, wherein the control circuit board is assembled in the housing; a laser light system, wherein the laser light system is disposed in the housing and is electrically connected to the control circuit board, and the laser light system is used to emit star-shaped lights; a water ripple light path system, wherein the water ripple light path system is disposed in the housing, a light emitting part of the water ripple light path system faces the optical lens, and the water ripple light path system is electrically connected to the control circuit board; and a battery, wherein the battery is electrically connected to the control circuit board.

In a preferred embodiment, the water ripple light path system comprises: a driving assembly, wherein the driving assembly is assembled in the housing and is electrically connected to the control circuit board; a water pattern sheet, wherein the water pattern sheet is disposed on an output shaft of the driving assembly; and an LED light group, wherein the LED light group is electrically connected to the control circuit board, and a light emitting part of the LED light group faces the water pattern sheet.

In a preferred embodiment, the LED light group and the driving assembly are detachably assembled each other.

In a preferred embodiment, an operating component electrically connected to the control circuit board is further provided outside the housing.

In a preferred embodiment, the base is further provided with a speaker electrically connected to the control circuit board and a sound outlet, and a microphone is arranged on another side of the housing.

In a preferred embodiment, anti-slip lines are further provided outside the housing.

In a preferred embodiment, an assembly part is disposed between the housing and the base.

In a preferred embodiment, the assembly part comprises: a clamp ring, wherein the clamp ring is disposed on the base, and the housing is provided with a matching groove for engaging to the clamp ring by snap-fixing; a straight threaded sleeve, wherein the straight threaded sleeve is disposed in the housing, and a threaded port of the straight threaded sleeve faces the base; and a threaded seat, wherein the threaded seat is disposed in the base, one end of the threaded seat corresponds to the straight threaded sleeve, and another end of the threaded seat is communicated with an outside.

After adopting the above technical solution, the beneficial effects of the present disclosure are as follows.

1. The starry sky lamp body is provided with a base and a housing, and a projection lamp assembly is disposed in the housing, and the projection lamp assembly comprises: a gobo mapper, wherein the gobo mapper is provided with a slot, and the housing is provided with a replacement slot on one side adjacent to the slot, and the slot is for a user to insert different gobos through the replacement slot. The starry sky light set in this way effectively solves the problem that the existing starry sky lights are often troublesome to replace the projection screen, and the projection screen cannot be customized, making the projection effect too single. It has the convenience of replacing the projection screen and can be customized according to customer needs, so as to customize the projection screen, making the advantages of diversified projection effects.

2. The housing is detachably equipped with optical lenses, and there are several optical lenses, and the mirror surface of each optical lens is different. When the user replaces different optical lenses, the displayed nebulae are also different, thus making the starry sky projection picture of the lamp is more abundant.

BRIEF DESCRIPTION OF THE DRAWINGS

In order to explain the embodiments of the present disclosure or the technical solutions in the prior art more clearly, the following will briefly introduce the drawings that need to be used in the description of the embodiments or the prior art. Obviously, the drawings in the following description are only some embodiments of the present disclosure. For those of ordinary skill in the art, other drawings can be obtained based on these drawings without creative labor.

Figure 1:
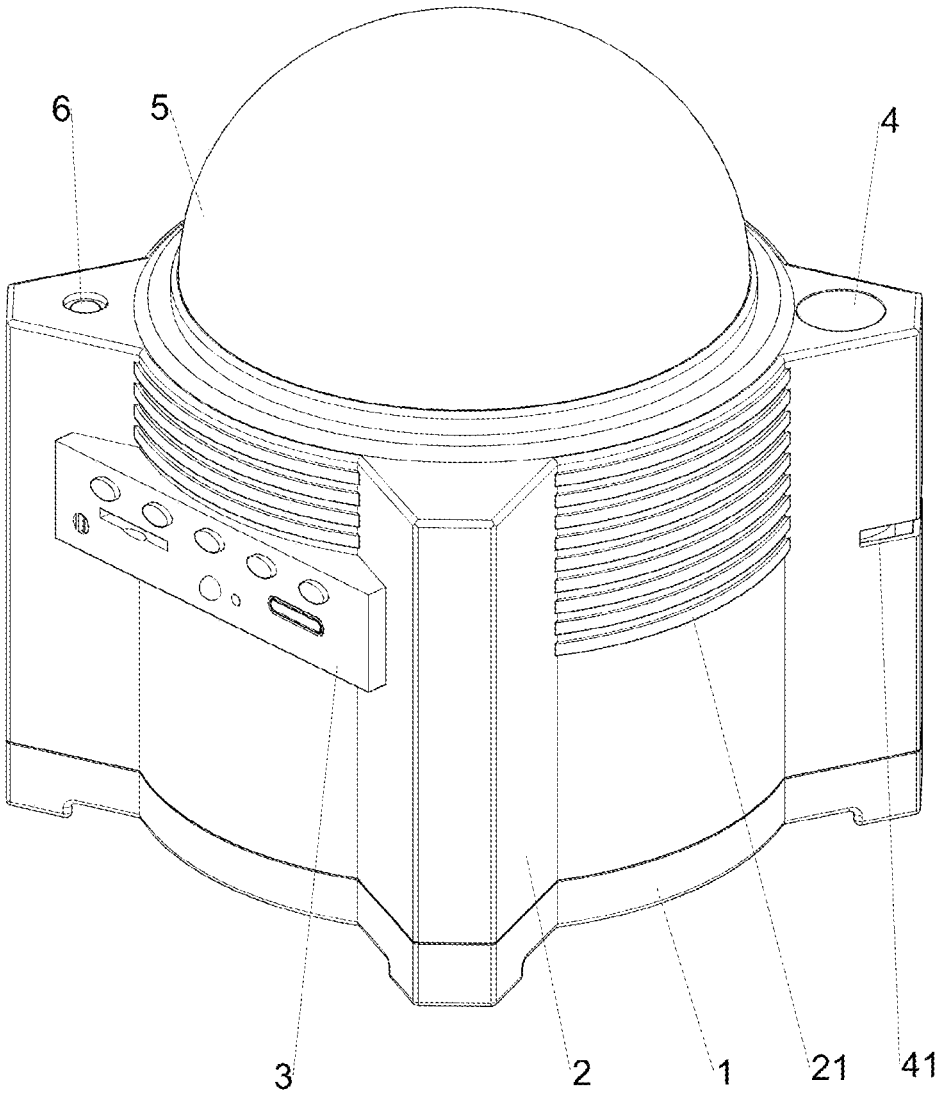
FIG. 1 is a schematic diagram of the structure of the present disclosure.

Reference numeral: 1. base; 11. threaded seat; 111. straight threaded sleeve; 12. clamp ring; 121. matching groove; 13. sound hole; 2. housing; 21. anti-slip lines; 3. operating component; 31. charging socket; 32. indicator light; 33. microphone; 34. memory card socket; 35. button; 36. control circuit board; 37. connection port; 38. infrared receiver; 4. projection lamp assembly; 41. replacement slot; 42. lamp body; 421. gobo mapper; 43. fixing seat; 44. convex mirror; 5. optical lens; 51. clamping block; 52. clamping slot; 6. laser light system; 61. laser transmitter; 62. grating sheet; 7. speaker; 71. support rod; 8, driving assembly; 81. mounting post; 82. mounting plate; 821. second threaded hole; 83. motor mounting sleeve; 831. mounting ring; 84. motor; 841. threaded mounting seat; 842. first screw; 85. water pattern sheet; 86. second screw; 9. LED light; 91. PCB board; 911. first threaded hole; 92. condenser cup; 10. battery.

DETAILED DESCRIPTION OF THE EXEMPLARY EMBODIMENTS

Hereinafter, the present disclosure will be further described in detail with reference to the accompanying drawings.

This specific embodiment is only an explanation of the present disclosure, and it is not a limitation of the present disclosure. After reading this specification, those skilled in the art can make modifications to this embodiment that do not create any contribution as needed, but as long as it is within the scope of the claims of the present disclosure, it is protected by the patent law.

This embodiment relates to a starry sky projection apparatus. As shown in FIG. 1, the starry sky lamp body is provided with a base 1, a housing 2 and a projection lamp assembly 4.

The starry sky lamp body is provided with a base 1 and a housing 2. The housing 2 and the base 1 can be detachably assembled to facilitate maintenance or replacement of internal electronic components. The housing 2 is provided with a replacement slot 41, which is used for connecting the internal with the outside world. A projection lamp assembly 4 is provided in the housing 2 on the side adjacent to the replacement slot 41. The projection lamp assembly 4 is adjacent to the inner wall of the housing 2. The projection lamp assembly 4 includes a gobo mapper 421, and the gobo mapper 421 is provided with an insertion slot, which faces the replacement slot 41, and the insertion slot allows the user to insert different gobos through the replacement slot 41, so as to embody the projection of different images. In this embodiment, anti-slip lines 21 are also provided outside the housing 2 to effectively prevent slippage when the user picks up the apparatus. The housing 2 is detachably provided with an optical lens 5, and there are several optical lenses 5, and the mirror surface of each optical lens 5 is different. When the user replaces a different optical lens 5, the displayed nebula is also different, making the projection picture of the starry sky lamp more abundant. In this embodiment, the bottom of the optical lens 5 is provided with a clamping block 51, and the housing 2 is provided with an opening, and the size of the opening is adapted to the optical lens 5 so that the light of the light-emitting element inside can directly irradiate the optical lens 5. The opening of the housing 2 is provided with a clamping slot 52 that is rotatably clamped with the clamping block 51.

Preferably, the projection lamp assembly 4 further includes a lamp body 42, a fixing base 43 and a convex mirror 44. The lamp body 42 is adjacent to the inner wall of the housing 2. The lamp body 42 is used to provide a light source for the pattern mapper 421, and the fixing base 43 is disposed at the bottom of the lamp body 42, the fixing seat 43 is used to fix the bottom of the lamp body 42, and the convex mirror 44 is disposed on the top of the housing 2. The convex mirror 44 is used to diffuse the light of the lamp body 42 so as to make the projection effect softer. An assembly part is provided between the housing 2 and the base 1. The assembly part includes: a clamp ring 12 disposed on the base 1, and a matching groove 121 provided on the housing 2 that is clamped with the clamp ring 12, so that the assembly of the housing 2 and the base 1 is more rigorous and convenient for subsequent screw assembly. The straight threaded sleeve 111 is disposed in the housing 2, and the threaded port of the straight threaded sleeve 111 faces the base 1, the threaded seat 11 is disposed in the base 1, and one end of the threaded seat 11 corresponds to the straight threaded sleeve 111, another end of the threaded seat 11 is connected to the outside, and a bolt is screwed in through the connected position, then the threaded seat 11 and the straight threaded sleeve 111 can be threaded to fix the housing 2 and the base 1.

Figure 2:
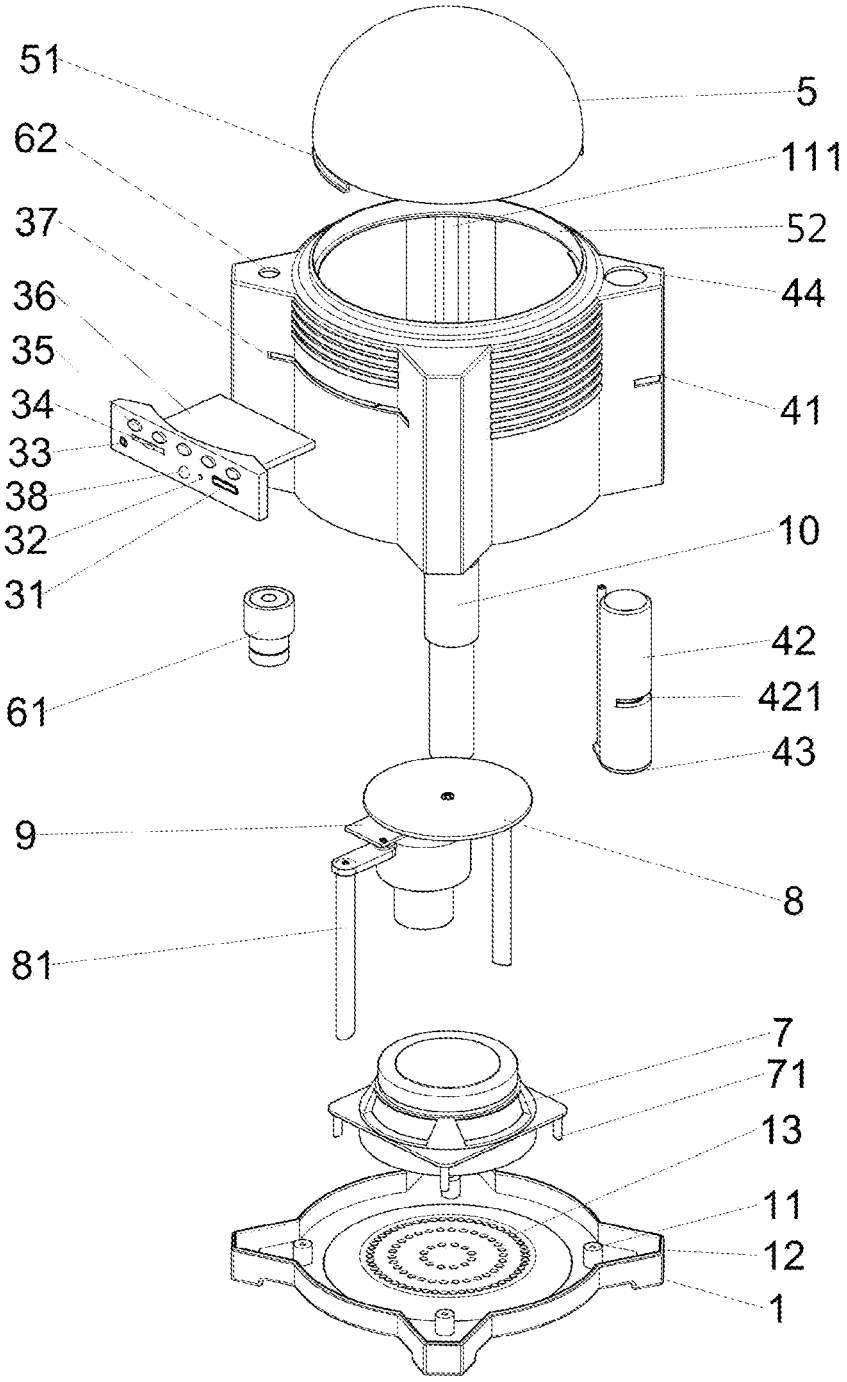
FIG. 2 is an exploded view corresponding to FIG. 1.
Figure 3:
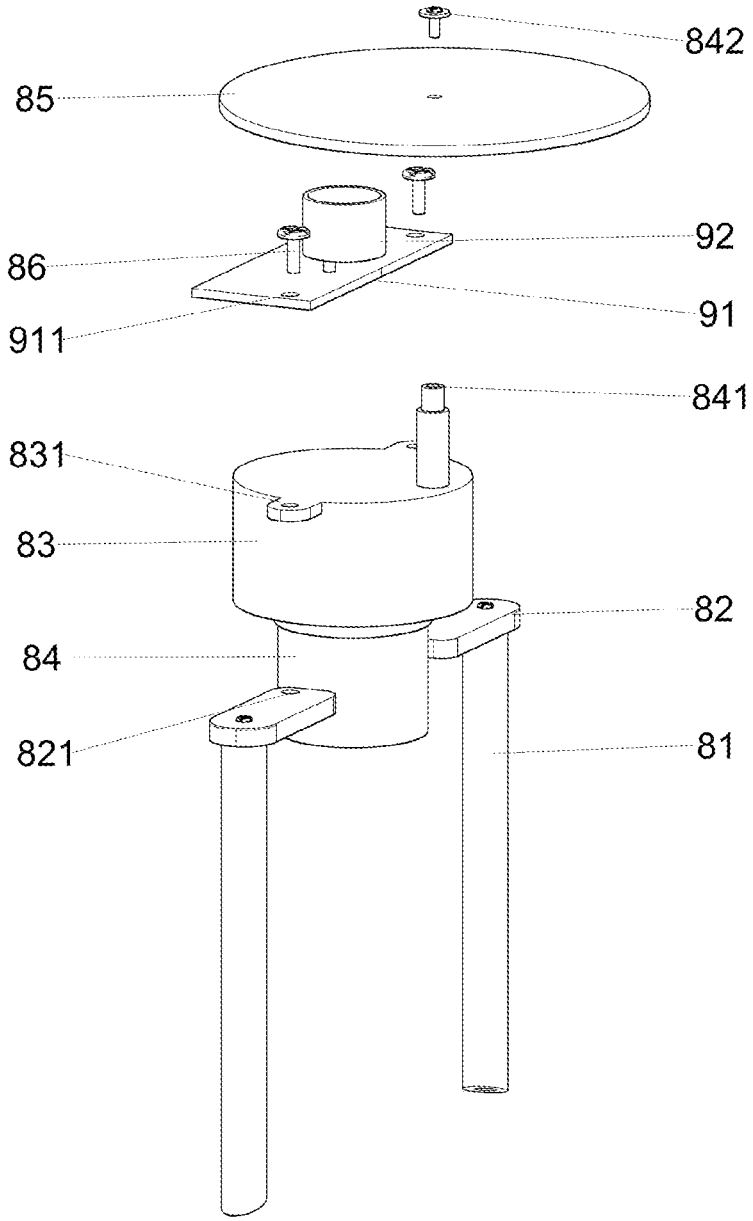
FIG. 3 is an exploded view of part of the structure of the present disclosure.
Figure 4:
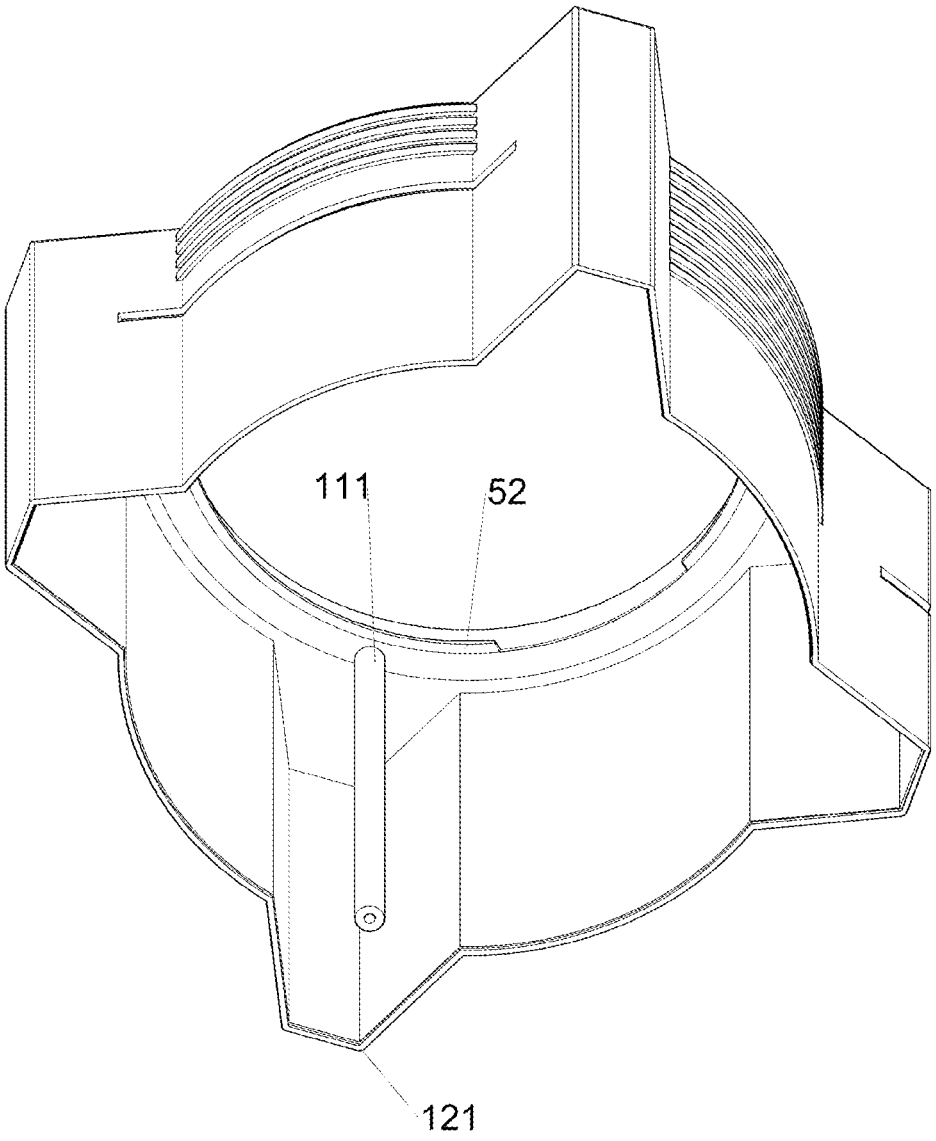
FIG. 4 is a bottom view of the housing of the present disclosure.

Preferably, as shown in FIG. 2, FIG. 3 and FIG. 4, it includes: a control circuit board 36, a laser light system 6, a water ripple light path system, a battery 10, a speaker 7 and an operating component 3.

The control circuit board 36 is assembled in the housing 2, the laser light system 6 is disposed in the housing 2 and is electrically connected to the control circuit board 36, the laser light system 6 is used to emit star-shaped lights, and the laser light system 6 includes: a laser transmitter 61 and grating sheet 62, the laser light emitter 61 is adjacent to the inner wall of the housing 2, the laser emitter 61 is opposite to the projection lamp assembly 4, and the light-emitting part of the laser emitter 61 is provided with a grating sheet 62, so that the emitted laser light is separated from one beam to become a number of beams to form a starry light effect. The water ripple light system is disposed in the housing 2 and relatively disposed between the laser system and the projection lamp assembly 4, and the water ripple light system is electrically connected to the control circuit board 36. The water ripple light system is used to emit water wave-shaped lighting effects, and the light-emitting part of the water ripple light system faces the optical lens 5, so that the wave-shaped light is refracted by the light lens, and finally forms the light of the nebula effect. The battery 10 and the control circuit board 36 are electrically connected to provide power for the entire apparatus, and the operating component 3 is electrically connected to the control circuit board 36. The base 1 is also provided with a speaker 7 electrically connected to the control circuit board 36, a sound hole is opened on the base 1, and the output part of the speaker 7 faces the sound hole. The speaker 7 is fixed on the base 1 through a number of support rods 71. The top of the housing 2 is also provided with a sound guide hole. The sound guide hole is used to prevent the sound of the speaker 7 from forming in the housing 2 and cause the sound quality to be unclear. The sound derived through the sound guide hole will be clearer. The sound guide hole can also be used as a heat dissipation hole to dissipate the heat emitted by the electronic components inside the housing 2 to prevent the inside of the housing 3 from overheating and damage the life of the internal electronic components.

Preferably, the operating component 3 includes: a charging socket 31, an indicator light 32, a microphone 33, a memory card socket 34, a button 35, a connection port 37 and an infrared receiver 38.

The housing 2 is provided with an operation panel for the installation of the operating component 3, and the housing 2 is also provided with a connection port 37. The position of the connection port 37 corresponds to the control circuit board 36. The connection port 37 is used for the button 35 and the control circuit board 36. For electrical connection, the charging socket 31 is used for type-c plugs or other plugs, and the battery 10 is charged through the control circuit board 36. The indicator light 32 is used to indicate the power of the starry sky light. When the power is low, the red light is displayed, and when the circuit is high, a green light is displayed. The microphone 33 is used for the internal microphone to receive the user's voice. The microphone is connected to the control circuit board 36, so that it can analyze the user's voice and convert the voice into instructions to control the turning on or off of the lights and audio, as well as the brightness of the lights and patterns, and the volume of the speaker can be adjusted to embody voice intelligence. The memory card socket 34 is for the user to insert an external memory card, so that the user can play his favorite music. There are several buttons 35, and the buttons 35 are used to control the light mode, switch different music, and adjust the volume of the music. The infrared receiver 38 is disposed on the operation panel and is electrically connected to the control circuit board 36. The infrared receiver 38 is used to receive remote control signals, thereby controlling light and sound.

Preferably, the water ripple light path system includes: a driving assembly 8, a water pattern sheet 85, and an LED light 9 group.

The driving assembly 8 is assembled in the housing 2, and is electrically connected to the control circuit board 36. The water pattern sheet 85 is disposed on the output shaft of the driving assembly 8, the LED light 9 group is electrically connected to the control circuit board 36, and the light emitting part of the LED light 9 group faces the water pattern sheet 85. When the water ripple light path system is activated, the LED light 9 group is activated and starts to emit light. The light passes through the water pattern sheet 85, causing the light to produce waves, and then is refracted by the optical lens 5 to make the wave pattern light lines more condensed to improve the final illumination effect, and the driving assembly 8 drives the water pattern sheet 85 to rotate slowly, so that the emitted water wave light rays produce a flowing effect. In this embodiment, the LED light 9 group and the driving assembly 8 are detachably assembled each other, and the water pattern sheet 85 is disposed in a circular shape.

Preferably, the driving assembly 8 includes a mounting post 81, a mounting plate 82, a second threaded hole 821, a motor 84, a motor mounting sleeve 83, a mounting ring 831, a threaded mounting seat 841, a first screw 842 and a second screw 86.

The mounting post 81 is fixedly assembled with the base 1, and is used to fix and assemble the driving assembly 8. The mounting plate 82 is assembled perpendicularly to the mounting post 81, and is provided with a second threaded hole 821, and the motor mounting sleeve 83 is provided with mounting ring 831. The second screw 86 penetrates the mounting ring 831 and the second threaded hole 821, so that the motor mounting sleeve 83 is mounted on the mounting plate 82, the motor 84 is set in the motor mounting sleeve 83, and the output shaft of the motor 84 faces the water pattern sheet 85. The output shaft of the motor 84 is provided with a threaded mounting seat 841, and the first screw 842 is inserted into the threaded mounting seat 841 through the water pattern sheet 85, so as to embody the detachable assembly of the output shaft of the motor 84 and the water pattern sheet 85. In this embodiment, the motor 84 is a geared motor 84.

Preferably, the LED light 9 group includes: a LED light 9, a PCB board 91, a first threaded hole 911 and a condenser cup 92.

The PCB board 91 is electrically connected to the control circuit board 36. The PCB board 91 is provided with a first threaded hole 911 corresponding to the mounting ring 831. The first threaded hole 911 is used for the first screw 842 to pass through, thereby connecting the PCB board 91. The mounting ring 831 and the mounting board 82 are assembled in one piece. The LED light 9 group is disposed on the PCB board 91. The condenser cup 92 is disposed around the LED light 9 group, and the opening of the condenser cup 92 faces the water pattern sheet 85, thereby reducing the side beam of the light beam and reducing the influence on the final light effect.

The working principle of the present disclosure is roughly as follows. The starry sky lamp body is provided with a base 1 and a housing 2, and the housing 2 and the base 1 can be detachably assembled to facilitate maintenance or replacement of internal electronic components. The housing 2 is provided with a replacement slot 41. The replacement slot 41 allows the inside of the housing 2 to communicate with the outside world. The projection lamp assembly 4 is provided in the housing 2 on the side adjacent to the replacement slot 41. The projection lamp assembly 4 is adjacent to the inner wall of the housing 2. The projection lamp assembly 4 includes a gobo mapper 421. The gobo mapper 421 is provided with a slot, which faces the replacement slot 41, and the slot allows the user to insert different gobos through the replacement slot 41, so as to embody the projection of different images. In this embodiment, anti-slip lines 21 are also provided outside the housing 2 to effectively prevent slippage when the user picks up the device. The housing 2 is detachably provided with an optical lens 5, and there are several optical lenses 5, and the mirror surface of each optical lens 5 is different. When the user replaces a different optical lens 5, the displayed nebula is also different, making the projection picture of the starry sky lamp more abundant. The starry sky light set in this way effectively solves the problem that the existing starry sky lights are often troublesome to replace the projection screen, and the projection screen cannot be customized, which makes the projection effect too single. The present disclosure is convenient to replace the projection screen and can be customized according to customer needs, so as to customize the projection screen, making the advantages of diversified projection effects.

The above are only used to illustrate the technical solution of the present disclosure and not to limit it. As long as other modifications or equivalent replacements made by those of ordinary skill in the art to the technical solution of the present disclosure does not deviate from the spirit and scope of the technical solution of the present disclosure, it shall be covered by the scope of the claims of the present disclosure.

What is claimed is:

1. A starry sky projection apparatus, comprising a starry sky lamp body, wherein the starry sky lamp body is provided with a base (1) and a housing (2), and a projection lamp assembly (4) is disposed in the housing (2), and the projection lamp assembly (4) includes:

a gobo mapper (421), wherein the gobo mapper (421) is provided with a slot, and the housing (2) is provided with a replacement slot (41) on one side adjacent to the slot, and the slot is for a user to insert different gobos through the replacement slot (41);

wherein an assembly part is disposed between the housing (2) and the base (1);

wherein the assembly part includes:

a clamp ring (12), wherein the clamp ring (12) is disposed on the base (1), and the housing (2) is provided with a matching groove (121) for engaging to the clamp ring (12) by snap-fixing;

a straight threaded sleeve (111), wherein the straight threaded sleeve (111) is disposed in the housing (2), and a threaded port of the straight threaded sleeve (111) faces the base (1); and a threaded seat (11), wherein the threaded seat (11) is disposed in the base (1), one end of the threaded seat (11) corresponds to the straight threaded sleeve (111), and another end of the threaded seat (11) is communicated with an outside.

2. The starry sky projection apparatus according to claim 1, wherein an optical lens (5) is detachably disposed on the housing (2).

3. The starry sky projection apparatus according to claim 2, wherein starry sky lamp body further includes:

a control circuit board (36), wherein the control circuit board (36) is assembled in the housing (2);

a laser light system (6), wherein the laser light system (6) is disposed in the housing (2) and is electrically connected to the control circuit board (36), and the laser light system (6) is used to emit star-shaped lights;

a water ripple light path system, wherein the water ripple light path system is disposed in the housing (2), a light emitting part of the water ripple light path system faces the optical lens (5), and the water ripple light path system is electrically connected to the control circuit board (36); and a battery (10), wherein the battery (10) is electrically connected to the control circuit board (36).

4. The starry sky projection apparatus according to claim 3, wherein the water ripple light path system includes:

a driving assembly (8), wherein the driving assembly (8) is assembled in the housing (2) and is electrically connected to the control circuit board (36);

a water pattern sheet (85), wherein the water pattern sheet (85) is disposed on an output shaft of the driving assembly (8); and an LED light (9) group, wherein the LED light (9) group is electrically connected to the control circuit board (36), and a light emitting part of the LED light (9) group faces the water pattern sheet (85).

5. The starry sky projection apparatus according to claim 4, wherein the LED light (9) group and the driving assembly (8) are detachably assembled to each other.

6. The starry sky projection apparatus according to claim 3, wherein an operating component (3) electrically connected to the control circuit board (36) is further provided outside the housing (2).

7. The starry sky projection apparatus according to claim 3, wherein the base (1) is further provided with a speaker (7) electrically connected to the control circuit board (36), and a sound outlet, and a microphone is disposed on another side of the housing (2).

8. The starry sky projection apparatus according to claim 1, wherein anti-slip lines (21) are further provided outside the housing (2).

* * * * *